US005419141A

United States Patent [19]

Burk

[11] Patent Number: 5,419,141

[45] Date of Patent: May 30, 1995

[54] AIR CONDITIONER FOR A VEHICLE

[75] Inventor: Roland Burk, Stuttgart, Germany

[73] Assignee: Behr GmbH & Co., Stuttgart, Germany

[21] Appl. No.: 258,065

[22] Filed: Jun. 10, 1994

[30] Foreign Application Priority Data

Jun. 10, 1993 [DE] Germany ..... 43 19 293.9

[51] Int. Cl.[6] ..... F25B 43/02

[52] U.S. Cl. ..... 62/474; 62/509

[58] Field of Search ..... 62/474, 195, 509, 512, 62/125, 126, 298, 129

[56] References Cited

U.S. PATENT DOCUMENTS

| | | | |
|---|---|---|---|
| 2,556,292 | 6/1951 | Newcum . | |
| 2,705,405 | 4/1955 | Uhlman . | |
| 3,064,819 | 11/1962 | Jones | 62/474 |
| 4,768,355 | 9/1988 | Breuhan et al. | 62/474 |
| 4,982,576 | 1/1991 | Proctor | 62/195 |
| 4,994,185 | 2/1991 | Cullen et al. | 62/474 |
| 5,038,582 | 8/1991 | Takamatsu | 62/474 |
| 5,159,821 | 11/1992 | Nakamura . | |

FOREIGN PATENT DOCUMENTS

| | | |
|---|---|---|
| 1601045 | 6/1970 | Germany . |
| 3815937 | 11/1989 | Germany . |
| 4018585 | 12/1991 | Germany . |
| 4035071 | 5/1992 | Germany . |

OTHER PUBLICATIONS

Patent Abstracts of Japan, M-1254 May 26, 1992, vol. 16/No. 226.

*Primary Examiner*—John M. Sollecito
*Attorney, Agent, or Firm*—Evenson, McKeown, Edwards & Lenahan

[57] ABSTRACT

An air conditioner arrangement for a vehicle, especially a motor vehicle, having a condenser designed as a block of tubes and ribs with lateral collecting tubes on both sides. One of the collecting tubes forms a structural unit with a collector, which contains a dryer and has a cage-shaped sleeve in which dryer granulate is contained in a bag.

9 Claims, 1 Drawing Sheet

Fig.1
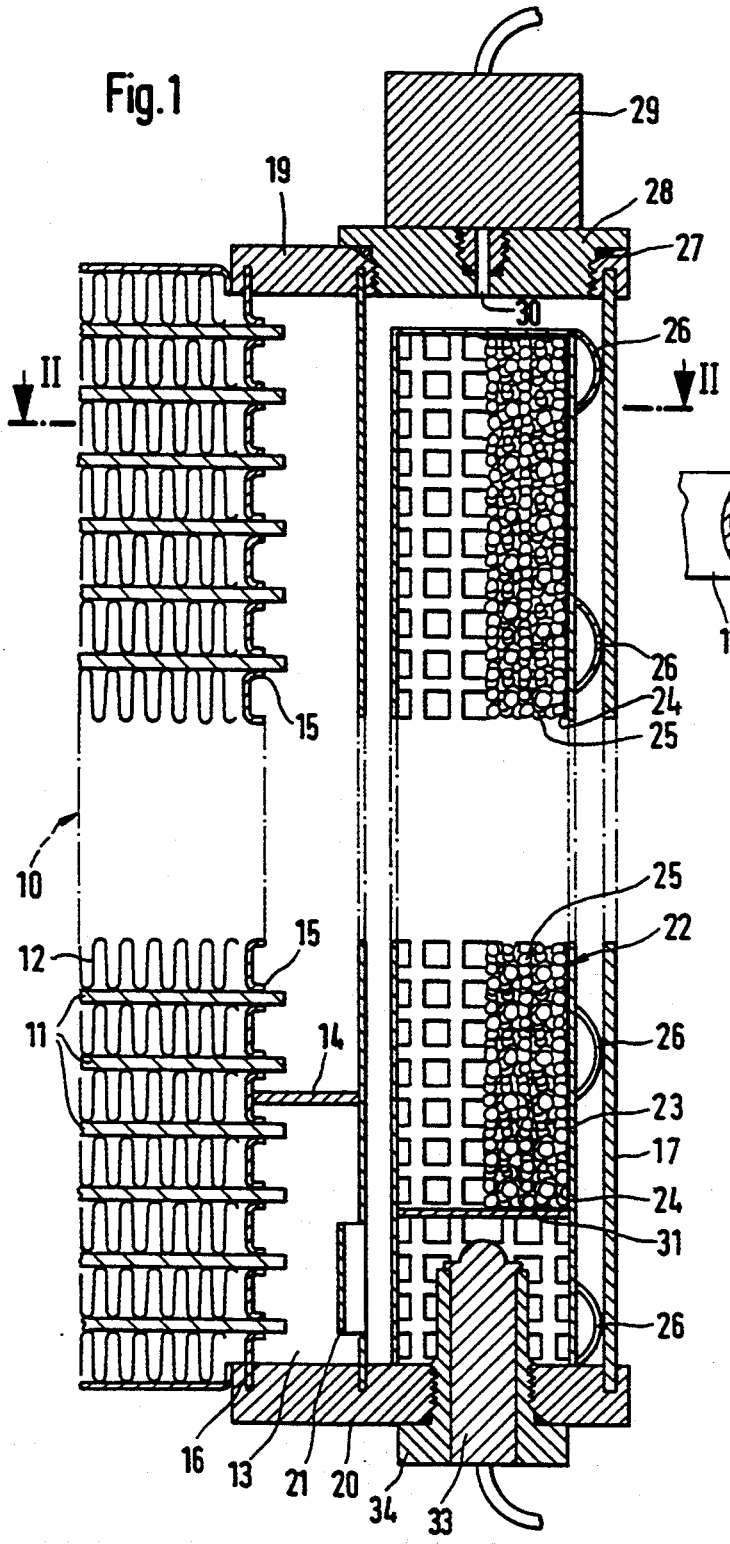
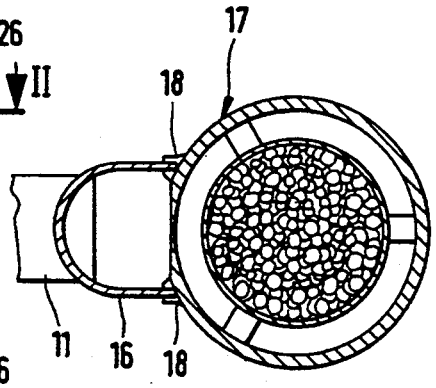
Fig.2

AIR CONDITIONER FOR A VEHICLE

BACKGROUND AND SUMMARY OF THE INVENTION

The present invention relates to an air conditioner for a vehicle with a condenser designed as a block of tubes and ribs with lateral collecting tubes arranged on both sides, and with a dryer for a refrigerant contained in a collector.

In known air conditioners for vehicles, a unit composed of a refrigerant collecting container, called a collector for short, and a dryer is located somewhere at a suitable point in the engine compartment and is connected by lines and releasable connections with the condenser. The unit composed of the dryer and collector is replaced approximately every two years to make sure the refrigerant in the cooling circuit remains free of water. As a rule, this unit composed of the collector and the dryer is traversed by all of the refrigerant.

An object of the present invention is to improve an air conditioner of the above-described general type with respect to operating safety and space requirements.

This and other objects are achieved by the present invention which provides a collector arranged parallel to a collecting tube of the condenser to form a structural unit therewith, and by a dryer having a cage-like sleeve, in which a dryer granulate is located in a refrigerant-permeable bag.

With the present invention, there are no screw connections or lines to a collector located separately, so that the result is greater system tightness and a smaller required amount of refrigerant. In addition, there is the advantage that the entire collector need not be removed but only the dryer with the bag and the dryer granulate, i.e. a dryer cartridge. This also entails lower costs and less material to be disposed of when a dryer is changed and hence improved environmental friendliness. Since as a rule the condenser is located at a relatively readily accessible location, the dryer is also readily accessible for replacement, so that installation work can be performed simply and economically.

In order to improve exchangeability even further, in certain embodiments the upper end of the collector is provided with a removable cover that closes an opening whose cross-section is greater than the cross-section of the cage-shaped sleeve. After the cover is removed, the cage-shaped sleeve with the dryer granulate can easily be removed at the top. It is especially advantageous in this connection for the cover to be made in the form of a screw so that simple installation is possible.

In certain embodiments of the invention, provision is made for the cover to contain a pressure sensor or pressure switch. This makes it possible to locate such a pressure sensor or pressure switch at a favorable location so that it is readily accessible.

In certain embodiments of the invention, provision is made for the sleeve to be provided on its exterior with elastic spacers which hold the sleeve in the collector while leaving an annular gap. This ensures that the dryer comes into sufficient contact with the liquid refrigerant without being traversed by all of the refrigerant.

In certain embodiments of the invention, provision is made for the sleeve to be provided at a distance from its lower end with a bottom and for a level sensor to be located in this area of the collector. This makes it possible in advantageous fashion to locate a level sensor at a suitable location to permit effective monitoring of the refrigerant quantity.

Other objects, advantages and novel features of the present invention will become apparent from the following detailed description of the invention when considered in conjunction with the accompanying drawings.

BRIEF DESCRIPTION OF THE DRAWINGS

FIG. 1 shows a vertical section through a part of a condenser which forms a structural unit with a collector and a dryer located therein, constructed in accordance with an embodiment of the present invention.

FIG. 2 is a section along line II—II in FIG. 1.

DETAILED DESCRIPTION OF THE DRAWINGS

The condenser, only partially shown in the drawing, is part of a refrigerant circuit of an air conditioner of a vehicle, especially a motor vehicle. In this condenser, the gaseous refrigerant which arrives is liquefied once again. The condenser contains a block (10) with flat tubes (11) running horizontally, between which corrugated ribs (12) are disposed. The ends of the flat tubes (11) are inserted into collecting tubes (13) with such collecting tubes being located on both sides of the tubular ribbed block. The collecting tubes (13) are divided by partitions (14), of which only one is shown in FIG. 1, in order to create a meander-shaped flow of the refrigerant. The ends of the flat tubes (11) are inserted in passageways through a sheet-metal shape (16) which is shaped into a collecting tube (13). The collecting tube (13) shown in the drawing is formed from the shaped sheet metal (16) and from an additional tube which serves as a collector (17) and is integrated into the condenser. Tube (16), as shown in FIG. 2, is bent essentially into a C shape and has its ends inserted into recesses (18) in collector (17). Collecting tube (13) and collector (17) are sealed by common sealing plates (19, 20).

The parts of the condenser described above, i.e. the block (10) of tubes and ribs, the collecting tubes (13), and the collector (17), form a fitted-soldered structure. The individual elements are braze-bonded. After being fitted together in a form of preassembly, they are soldered in a furnace to produce the finished structure.

Collector (17) is provided in the vicinity of its lower end with an opening (21) that provides a connection to the collecting tube (13). Preferably an additional opening is provided above partition (14) so that the lower part of collector (17) is necessarily traversed by the refrigerant.

A dryer (22) is located in collector (17). Dryer (22) has a cage-shaped sleeve (23) made of metal or plastic, whose diameter is less than the diameter of the collector (17), so that an annular gap is left between the two. A bag (24) of a fine-mesh fabric or nonwoven fabric is contained in sleeve (23) and contains a loose amount of dryer granulate. A suitable molecular sieve is used as a dryer granulate, especially Zeolite. The bag (24) is permeable to the refrigerant. Bag (24) and granulate (25) are shown in FIG. 1 only in the right-hand half of sleeve (23) shown in the drawing although the entire sleeve (23) is filled with it.

Sleeve (23) is provided on its exterior with elastic spacers (26) shaped for example in the manner of spring clips on the sleeve (23). These spacers (26) are arranged at angular intervals of 120° and serve to center the sleeve (23) in the collector (17).

The upper sealing plate (19) has an opening designed as a threaded bore whose cross-section is greater than the cross-section of the sleeve (23). This opening is sealed with interposition of a sealing ring (27) with a screw cover (28). After the screw cover (28) is removed, the dryer (22) is readily accessible and can be removed at the top. In order to secure the sleeve (23) in the vertical direction in the collector (17), it is advantageous to provide a supporting element between the screw cover (28) and the upper end of sleeve (23), for example a spring that can have the form of clip (26). In a modified embodiment, provision is made such that the lower support plate (20) which serves as the bottom of the collector (17) and the lower end of sleeve (23) are provided with locking elements that engage one another, for example in the manner of a bayonet connection. In this manner it is possible to secure dryer (22) in the axial direction after insertion into collector (17) by twisting. In order to be able to remove dryer (22) easily, it is advantageous for its upper end to be provided with an engagement surface for a tool, for example a clip onto which a hook can be inserted.

In addition, a pressure sensor or pressure switch (29) is also mounted on the screw cover (28) which is screwed with a projection into a threaded bore in the screw cover (28), through which a bore (30) leads to the pressure sensor or pressure switch (29).

The sleeve (23) is provided with a bottom (31) at a distance from its lower end so that an end segment is created which is free of dryer granulate. An optical level sensor (33) is located in this end section. The optical level sensor (33) is provided with a screw insert (34) which is screwed into a threaded bore in the lower sealing plate (20). The level sensor (33) detects with its upper hemispherical end projecting out of insert (34), whether a liquid or gaseous refrigerant is present in this area. If the presence of gaseous refrigerant is determined in this area, a signal is generated to indicate that maintenance or topping up is needed.

The dryer (22) is not necessarily traversed by the refrigerant. However, the dryer (22) is provided in the collector (17), so that reliable uptake of any water contained in the refrigerant is possible.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Air conditioner arrangement for a vehicle with a condenser having a block of tubes between which are arranged ribs, and having collecting tubes, one of said collecting tubes being located on each side of said block, the tubes being arranged orthogonally with respect to the collecting tubes, comprising:

a collector parallel to and coupled to one of the collecting tubes to form a structural unit therewith;

a dryer for drying refrigerant and which is within the collector, the dryer having a cage-shaped sleeve having a bag contained therein, said bag containing a dryer granulate and being permeable to the refrigerant;

wherein said one collecting tube of the condenser and the collector form a tube-shaped structural element having two ducts extending in parallel to one another, of which one duct is used as the collecting tube for the condenser and the other is used as the collector for the dryer, said two ducts being connected with one another by at least one opening in a wall of said two ducts.

2. Air conditioner arrangement according to claim 1, wherein the collector has an upper end with a removable cover which closes an opening of the collector that has a cross section greater than the cross section of the cage-shaped sleeve.

3. Air conditioner arrangement according to claim 2, wherein the cover is a screw cover.

4. Air conditioner arrangement for a vehicle with a condenser having a block of tubes between which are arranged ribs, and having collecting tubes, one of the collecting tubes being located on each side of said block, the tubes being arranged orthogonally with respect to the collecting tubes, comprising:

a collector parallel to and coupled to one of the collecting tubes to form a structural unit therewith;

a dryer for drying refrigerant and which is within the collector, the dryer having a cage-shaped sleeve having a bag contained therein, said bag containing a dryer granulate and being permeable to the refrigerant;

wherein the collector has an upper end with a removable cover which closes an opening of the collector that has a cross section greater than the cross section of the cage-shaped sleeve, such that the dryer can be inserted and removed from the collector;

wherein the cover is a screw cover; and wherein the cover contains at least one of a pressure sensor and a pressure switch.

5. Air conditioner arrangement according to claim 1, wherein the sleeve has an exterior with elastic spacers which hold the sleeve in a spaced relationship with an annular gap in collector.

6. Air conditioner arrangement according to claim 1, wherein the sleeve has a bottom at a distance from its lower end and further comprising a level sensor located in this area of the collector.

7. Air conditioner arrangement according to claim 6, further comprising a bottom cover removably connected to a bottom of the collector, the level sensor being held by said bottom cover.

8. Air conditioner arrangement according to claim 2, further comprising elastic supporting means between the cover and the upper end of the sleeve.

9. Air conditioner arrangement according to claim 8, wherein the upper end of sleeve has a receiving element for a tool.

* * * * *